United States Patent [19]

Orova et al.

[11] 4,329,950

[45] May 18, 1982

[54] MAGNETO IGNITION SYSTEM WITH INCREASED SPARK ENERGY

[75] Inventors: Josef Orova, Schwabach; Jiri Podrapsky, Buchschwabach, both of Fed. Rep. of Germany

[73] Assignee: Robert Bosch GmbH, Stuttgart, Fed. Rep. of Germany

[21] Appl. No.: 265,592

[22] Filed: May 20, 1981

Related U.S. Application Data

[63] Continuation of Ser. No. 81,770, Oct. 4, 1979, abandoned.

[30] Foreign Application Priority Data

Nov. 25, 1978 [DE] Fed. Rep. of Germany ..... 2851097

[51] Int. Cl.[3] ..... F02P 3/06; H05B 37/02

[52] U.S. Cl. ..... 123/149 C; 123/599; 123/149 D; 123/605; 315/209 T

[58] Field of Search ..... 123/599, 605, 656, 149 C, 123/149 D; 315/209 T

[56] References Cited

U.S. PATENT DOCUMENTS

| | | | |
|---|---|---|---|
| 3,508,116 | 4/1970 | Burson | 123/149 D |
| 3,605,713 | 9/1971 | Masters et al. | 315/209 T |
| 3,938,491 | 2/1976 | Mazza | 123/149 D |
| 4,117,820 | 10/1978 | Kashiwazaki et al. | 123/149 D |
| 4,174,697 | 11/1979 | Podrapsky et al. | 123/149 C |
| 4,175,509 | 11/1979 | Orova et al. | 123/149 C |
| 4,178,892 | 12/1979 | Podrapsky et al. | 315/209 T |
| 4,188,929 | 2/1980 | Podrapsky et al. | 315/209 T |

*Primary Examiner*—P. S. Lall

*Attorney, Agent, or Firm*—Frishauf, Holtz, Goodman & Woodward

[57] ABSTRACT

On-off oscillations immediately following the initiation of the spark in a magneto ignition system are prevented by a timing circuit the capacitor of which is charged continually even during the spark time and whose discharge time constant exceeds 10 μs. The capacitor is discharged through the emitter-base circuit of a control transistor and keeps the control transistor in a saturated state throughout the desired spark duration. While the control transistor is in the saturated state, it shortcircuits the emitter-base circuit of the ignition transistor, thereby blocking the ignition transistor continuously. Since the capacitor of the timing circuit is continually charged, the actual spark duration greatly exceeds the 10 μs time constant of the timing circuit and may be as high as 1.2 ms.

5 Claims, 1 Drawing Figure

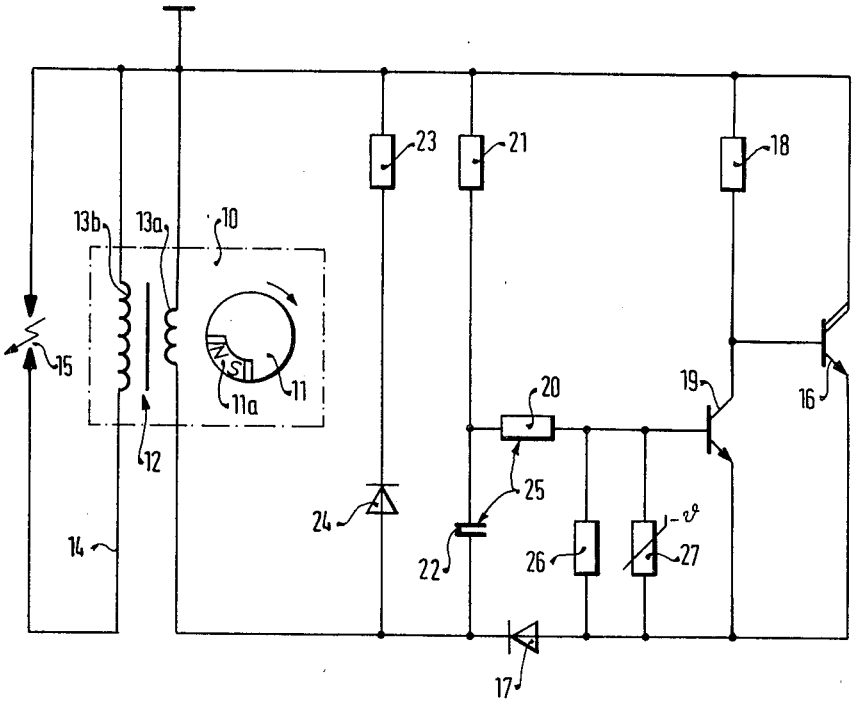
23
21
18
13b
13a
10
15
N
S
11
11a
12
20
19
16
25
24
22
26
27
ϑ
14
17

MAGNETO IGNITION SYSTEM WITH INCREASED SPARK ENERGY

This is a continuation of application Ser. No. 081,770 filed Oct. 4, 1979, now abandoned.

Cross-reference to related applications and publications:

DE-OS No. 27 01 750

The present invention relates to ignition systems, and, in particular, to ignition systems utilizing a magneto generator.

BACKGROUND AND PRIOR ART

In the known ignition system (DE-OS No. 27 01 750), a control capacitor is connected in series with a threshold switch in the primary circuit of the ignition system. The capacitor causes the ignition timing discharge to be changed as a function of engine speed. When the ignition current in the primary circuit of the ignition system is blocked at the ignition time, oscillations occur which are coupled back to a control circuit connected to the ignition transistor in such a way that the ignition transistor oscillates back and forth from the blocked into the conductive region. This causes a plurality of sparks to be initiated at the spark plug which is connected to the secondary winding of the ignition coil. Each individual spark only has a duration of approximately 10 to 100 ms. so that the available ignition energy is relatively small.

THE INVENTION

It is an object of the present invention to furnish a magneto ignition system of the above-described type in which the discharge of the control capacitor through a coupling resistor is so controlled that the oscillations of the control transistor and the ignition transistor occurring in the known system at the ignition time will be suppressed. In this manner, the system of the present invention is to furnish a spark having a high ignition energy and a long duration, for example up to 1.2 ms.

It is a further object of the present invention to decrease the power dissipated in the ignition transistor, again by suppressing the above-mentioned oscillations.

In accordance with the present invention, timing circuit means are provided which cause the control transistor to be maintained in a state maintaining the ignition transistor in the blocked state throughout a time not less than 300 μs, so that a spark of at least that duration will be produced.

DRAWING ILLUSTRATING A PREFERRED EMBODIMENT

The single FIGURE is a circuit diagram of an ignition circuit according to the present invention as used in a single cylinder internal combustion engine.

THE DESCRIPTION OF A PREFERRED EMBODIMENT

Circuit shown in FIG. 1 includes a magneto 10, which has a rotating magnetic system 11. A permanent magnet 11*a* is arranged between two pole pieces and is mounted on the outer perimeter of a flywheel or fan wheel of the internal combustion engine (not shown). Magnet system 11 cooperates with an armature 12 which is mounted in the housing of the internal combustion engine. Armature 12 also operates as an ignition coil and has a primary winding 13*a* and a secondary winding 13*b*. Secondary winding 13*b* is connected through an ignition cable 14 to a spark plug 15. Primary winding 13*a* of armature 12 is connected to a primary circuit which includes an npn ignition transistor 16 which acts as a switch. Ignition transistor 16 is connected as a Darlington circuit. Its collector is connected to the end of primary winding 13*a* which is connected to reference (ground) potential. Its emitter is connected through a diode 17 to the other end of primary winding 13*a*. Diode 17 prevents inverse current from flowing, and is therefore of a polarity corresponding to that of transistor 16. The base of transistor 16 is connected through a resistor 18 to its collector. The control circuit of transistor 16, that is, its base-emitter circuit, is connected to a control circuit which comprises a control transistor 19 having an emitter-collector circuit connected in parallel with the emitter-base circuit of transistor 16. Transistor 19 is an npn transistor. The base of transistor 19 is connected through a coupling resistor 20 of, for example, 1.5 k ohms, to the common point of a resistor 21 and a capacitor 22. The other end of resistor 21 is connected to ground potential, while the other terminal of capacitor 22 is connected to the other end of winding 13*a*. Resistor 21 may, for example, be a 200 ohm resistor, while the capacitance of capacitor 22 will be 22 nF. Also connected in parallel with winding 13*a* is a series circuit including a resistor 23 and a diode 24. This circuit suppresses the half-wave of the voltage appearing across winding 13*a* which is not required for ignition. During the half-wave required for transmission, diode 24 is blocked. Adjustment of resistor 23 or connection of a number of resistors in parallel will achieve the proper damping of the half-waves of magneto generator 10 which are not required for ignition.

In order to suppress the oscillatory behavior of ignition transistor 16 at the ignition time, a base current must be supplied to transistor 16 from capacitor 22 through coupling resistor 20 such that the emitter-collector circuit of transistor 19 remains fully conductive throughout the whole ignition process. For this purpose, it must be considered that capacitor 22 is continually charged during the ignition process. The time constant of the timing circuit 25 which includes capacitor 22 and resistor 20 should, for this purpose, be greater than 10 μs. The time constant $T=R\times C$ for the present example is given by:

$$T=1.5\times10^{3}\times22\times10^{-9}=33\ \mu s.$$

Because capacitor 22 is continually being charged, even during the ignition process, the time constant of the RC circuit 25 is smaller than the maximum spark duration. The actual time interval for which transistor 19 remains blocked is thus considerably longer than the time constant of the RC circuit 25. For the example given above, it will vary between 400 μs and 1.2 ms. as a function of engine speed.

An adjustment or balance or trim resistor 26 is connected in parallel with the base-emitter circuit of transistor 19 and, with resistor 20, forms a voltage divider across capacitor 22. Resistor 20 is used to match the characteristics of transistor 19 to the timing circuit 25 and to compensate for variations in the transfer characteristics of transistor 19 due to manufacturing tolerances. The required values of resistor 26 lie between 300 ohms and 2 kilo-ohms. Variations of the characteristics of transistor 19 as a function of temperature are compensated by a negative temperature coefficient resistor 27 which, for the given example, has a resistance of 10,000 ohms at 20° C. NTC resistor 27 is also connected in parallel with the base-emitter circuit of transistor 19.

During operation of the internal combustion engine, positive and negative voltage half-waves are induced in primary winding 13*a* of armature 12 by a magnetic system 11. As seen from the terminal of primary winding 13*a* which is connected to ground potential, the circuit including diode 24 and resistor 23 dampens the positive voltage half-wave sufficiently that the peak voltages cannot damage any of the circuit components. The negative voltage half-waves are utilized for generating the necessary ignition energy and for initiating the spark. At the start of each negative voltage half-wave, a control current flows through resistor 18 to the base-emitter circuit of ignition transistor 16. Ignition transistor 16 becomes conductive. Current flows through the emitter-collector circuit of transistor 16 and, therefore, through primary winding 13*a*. Further, capacitor 22 charges through the low resistance resistor 21. At the ignition time, the charge on capacitor 22 has reached the value which is required to switch transistor 19 to the fully conductive state. The emitter-collector circuit of transistor 19 therefore substantially short-circuits the base-emitter circuit of transistor 16. Transistor 16 blocks instantaneously. The primary current is therefore instantaneously interrupted, causing a high voltage pulse to appear in the primary winding 13*a* as well as in the secondary winding 13*b*. The high voltage pulse in the secondary winding causes a spark to be created at spark plug 15. The voltage pulse in the primary winding is applied through resistor 21 to capacitor 22 and recharges the latter. It is further applied through coupling resistor 20 to the base of transistor 19 and maintains the latter in the conductive state.

To summarize, the oscillatory circuit behavior resulting from interruption of the primary current on the one hand and dissipation of energy in the spark on the other hand is to be prevented from affecting transistor 16, thereby preventing the formation of short sparks having insufficient energy. The timing circuit 25 is therefore so designed that it has a sufficiently high time constant that sufficient current is applied to the base circuit of transistor 19 to keep it in the saturated region throughout the whole ignition process, thereby effectively short-circuiting the base-emitter circuit of transistor 16.

The circuit element values specified herein are for a 12 volt ignition system of a 1 cylinder engine. Transistors 16 and 19 are commercially available under catalog numbers BC337;TIP152. For ignition systems operating at a different voltage, corresponding adjustment of the various circuit components would have to be made.

Various changes and modifications may be made within the scope of the inventive concepts.

We claim:

1. In an ignition system having a magneto generator (10) having an armature (12) having a primary winding and a secondary winding, at least one spark plug connected to said secondary winding, controllable ignition switch means (16) connected to said primary winding, and control switch means (19) having an emitter-collector circuit connected to said ignition switch means and a base for switching said ignition switch means from a first state allowing current flow through said primary winding to a second state blocking said current flow at the ignition time, the improvement comprising a capacitor (22) having a first and second terminal;

a charging resistor (21) connected to said first terminal;

means for connecting the so-formed series circuit to said primary winding;

coupling resistor (20) having a first terminal connected to said first terminal of said capacitor and a second terminal connected to said base of said control switch means; and a balance or trim resistor (26) having a first terminal connected to said emitter and a second terminal connected to said second terminal of said coupling resistor, said capacitor and said coupling resistor together having a time constant ($T=R\times C$) exceeding 10 microseconds but creating a spark having a duration of not less than 300 microseconds by constant recharging of said capacitor during said discharge time through said charging resistor.

2. A system as set forth in claim 1, further comprising a negative temperature coefficient resistor interconnected between said base and said emitter of said control switch means.

3. A system as set forth in claim 2, wherein said negative temperature coefficient resistor has a resistance of approximately 10 k ohms at 20° C.

4. A system as set forth in claim 1, wherein said capacitor has a capacitance of approximately 22 nanofarads and said coupling resistor has a resistance of approximately 1.5 kilo ohms and said charging resistor has a resistance of approximately 200 ohms.

5. A system as set forth in claim 4, wherein said balance or trim resistor has a resistance value between 300 and two thousand ohms.

* * * * *

UNITED STATES PATENT AND TRADEMARK OFFICE

CERTIFICATE OF CORRECTION

PATENT NO. : 4,329,950

DATED : May 18, 1982

INVENTOR(S) : Josef OROVA and Jiri PODRAPSKY

It is certified that error appears in the above—identified patent and that said Letters Patent is hereby corrected as shown below:

Col. 1, line 28, change "ms" to --μs--.

Signed and Sealed this

*Seventh* Day of *September 1982*

[SEAL]

*Attest:*

GERALD J. MOSSINGHOFF

*Attesting Officer*

*Commissioner of Patents and Trademarks*